US006141989A

United States Patent [19]

Oakey

[11] Patent Number: 6,141,989

[45] Date of Patent: Nov. 7, 2000

[54] AIR SEPARATION

[75] Inventor: John Douglas Oakey, Godalming, United Kingdom

[73] Assignee: The BOC Group plc, Windlesham, United Kingdom

[21] Appl. No.: 09/215,592

[22] Filed: Dec. 17, 1998

[30] Foreign Application Priority Data

Dec. 19, 1997 [GB] United Kingdom ..... 9726954

[51] Int. Cl.[7] ..... F25J 3/00

[52] U.S. Cl. ..... 62/647; 62/653

[58] Field of Search ..... 62/653, 643, 646, 62/647

[56] References Cited

U.S. PATENT DOCUMENTS

| | | | |
|---|---|---|---|
| 4,594,085 | 6/1986 | Cheung | 62/646 |
| 4,854,954 | 8/1989 | Erickson . | |
| 5,074,898 | 12/1991 | Cheung | 62/646 |
| 5,355,682 | 10/1994 | Agrawal et al. . | |
| 5,379,598 | 1/1995 | Mostello | 62/646 |

FOREIGN PATENT DOCUMENTS

| | | |
|---|---|---|
| 0 438 282 A1 | 7/1991 | European Pat. Off. . |
| 0539268 | 4/1993 | European Pat. Off. . |
| 0701099 | 3/1996 | European Pat. Off. . |
| 0793070 | 9/1997 | European Pat. Off. . |
| 1224508 | 6/1960 | France . |
| WO1915725 | 10/1991 | WIPO . |

*Primary Examiner*—William Doerrler
*Attorney, Agent, or Firm*—Salvatore P. Pace

[57] ABSTRACT

Air is separated in a double rectification column comprising a higher pressure rectification column, a lower pressure rectification column, and a first condenser-reboiler, of which the condensing passages communicate with an upper region of the higher pressure rectification column, and the reboiling passage communicate with a lower region of the lower pressure rectification column. A second condenser-reboiler is operated so as to reboil a liquid fraction obtained in the higher pressure rectification column. A stream of the air to be separated is partially or totally condensed by indirect heat exchange with a stream of nitrogen condensed in the first condenser-reboiler. At least part of the stream of condensed nitrogen is taken as product downstream of its heat exchange with the second stream of compressed air.

19 Claims, 3 Drawing Sheets

AIR SEPARATION

BACKGROUND OF THE INVENTION

This invention relates to a method of and apparatus for separating air.

The separation of air by rectification (i.e. fractional distillation) is very well known indeed. Typically, the air is introduced into a double rectification column comprising a higher pressure rectification column, a lower pressure rectification column, and a condenser-reboiler, of which the condensing passages communicate with an upper region of the higher pressure rectification column and the reboiling passages communicate with a lower region of the lower pressure rectification column. Nitrogen is thereby separated in the higher pressure rectification column and is condensed in the condenser-reboiler. A part of the resulting condensate is used as reflux in the higher pressure column and another part of the condensate is so used in the lower pressure rectification column. An oxygen-enriched liquid air fraction is taken from the bottom of the higher pressure rectification column and is introduced into an intermediate mass exchange region of the lower pressure rectification column. A nitrogen fraction is obtained at the top of the lower pressure rectification column and an oxygen-enriched fraction at its bottom. A nitrogen product is therefore obtained at the pressure of the lower pressure rectification column.

Many industrial processes, for example the enhanced recovery of oil or gas, require nitrogen to be supplied at an elevated pressure, often in excess of that at which the higher pressure rectification column operates. In order to reduce the amount of work required to raise the pressure of the nitrogen product from that of the lower pressure rectification column to that demanded by the process to which the nitrogen is to be supplied, it is known to take some of the nitrogen product as vapour from the higher pressure rectification column. For a given recovery of nitrogen, the rate at which such higher pressure nitrogen can be so taken is, however, limited because the withdrawal of the nitrogen vapour from the higher pressure rectification column reduces the amount of liquid nitrogen reflux that is formed.

It is the aim of the present invention to provide a method and apparatus capable of being operated so as to mitigate the above-mentioned problem.

SUMMARY OF THE INVENTION

According to the present invention there is provided a method of separating air, in which air is introduced into a double rectification column comprising a higher pressure rectification column, a lower pressure rectification column, and a first condenser-reboiler of which the condensing passages communicate with an upper region of the higher pressure rectification column so as to condense nitrogen and the reboiling passages communicate with the lower region of the lower pressure rectification column; a second condenser-reboiler is operated so as to reboil a liquid fraction obtained in the higher pressure rectification column, and the second condenser-reboiler is heated either by means of a first stream of air to be separated, the first stream of air thereby being partially or totally condensed, or by a flow of nitrogen-rich vapour which is formed by pre-separating the first stream of air in a further rectification column operating at a higher pressure than any obtaining in the higher pressure rectification column, the nitrogen-rich vapour thereby being partially or totally condensed; a second stream of compressed air to be separated is partially or totally condensed by indirect heat exchange with a stream of the condensed nitrogen, and at least part of the stream of condensed nitrogen is taken as product downstream of its heat exchange with the second stream of compressed air.

The invention also provides apparatus for separating air comprising a double rectification column comprising a higher pressure rectification column, a lower pressure rectification column, and a first condenser-reboiler, of which the condensing passages communicate with an upper region of the higher pressure rectification column so as, in use, to condense nitrogen and the reboiling passages communicate with the lower region of the lower pressure rectification column; a second condenser-reboiler, of which the reboiling passages communicate with the lower region of the higher pressure rectification column, and the condensing passages communicate either directly with a source of the first stream of compressed air to be separated, or with a nitrogen-rich vapour region of the further rectification column which in turn communicates with the said source and which, in use, operates at a higher pressure than any obtaining in the higher pressure rectification column; a first further condenser for partially or totally condensing, by indirect heat exchange with the stream of the condensed nitrogen, a second stream of compressed air to be separated; and means for taking as product at least part of the stream of condensed nitrogen downstream of its heat exchange with the second stream of compressed air.

By reboiling liquid in a lower region of the higher pressure rectification column it becomes possible to enhance the rate at which vapour ascends this rectification column, thus providing a regime in the higher pressure rectification column which favours the withdrawal of a nitrogen product therefrom; further, by condensing a second stream of air the heat exchange load on the second condenser-reboiler is limited, thus helping to keep down the thermodynamic inefficiency associated with the operation of this second condenser-reboiler in examples of the method and apparatus according to the invention in which it is warmed by the first stream of compressed air. (In general, higher temperature differences between condensing and boiling fluid are required when the condensate is a mixture than when it is pure. Such higher temperature differences result in less efficient operation of the condenser-reboiler.) Alternatively, if the second condenser-reboiler is heated by the nitrogen-rich vapour separated in the further rectification column, condensing the second stream of compressed air helps to limit the size of the further rectification column. In addition, the condensation of the second stream of compressed air enables nitrogen to be vaporised at a higher pressure than that obtaining at the top of the higher pressure rectification column, thereby reducing the amount of compression which is typically subsequently required to raise the nitrogen product to a particularly elevated pressure, for example, in excess of 100 bar.

In examples of the method according to the invention in which the first stream of compressed air is introduced into the second condenser-reboiler, the resulting stream of partially or totally condensed air is preferably entirely introduced into the higher pressure rectification column at an intermediate mass exchange region thereof. In examples in which the further rectification column is employed a stream of oxygen-enriched liquid is preferably taken from the bottom of the further rectification column and introduced into the higher pressure rectification column for separation therein. In all examples of the method and apparatus according to the invention, the partially or totally condensed second stream of compressed air is preferably introduced entirely into the higher pressure rectification column at an intermediate region thereof. It is also preferred in all examples of the method and apparatus according to the present invention that a stream of liquid having a composition approximating to that of air be withdrawn from an intermediate mass exchange region of the higher pressure rectification column and introduced into an intermediate mass exchange region of the lower pressure rectification column. Alternatively, a part of the partially or totally condensed first air stream and/or a part of the partially or totally condensed second air stream may be introduced into an intermediate mass exchange region of the lower pressure rectification column. Preferably, the first and second streams of compressed air are compressed at the same pressure. This enables them to be taken from the same source and enables a relatively simple air compression system to be employed in providing the first and second streams of compressed air.

The said part of the stream of condensed nitrogen is preferably pumped to a pressure higher than that at the top of the higher pressure rectification column upstream of its heat exchange with the second stream of compressed air.

Typically, a product nitrogen stream is withdrawn in vapour state from the lower pressure rectification column. In order to enhance the amount of liquid nitrogen available in the method and apparatus according to the invention, a stream of nitrogen vapour is preferably taken out of mass exchange relationship with liquid in the lower pressure rectification column and is condensed. A second further condenser is used for this purpose.

A stream of oxygen-enriched liquid is preferably withdrawn from the lower pressure rectification column, is reduced in pressure and is employed to condense a stream of nitrogen vapour. Typically, some of the liquid nitrogen which is formed by condensation of nitrogen vapour taken out of mass exchange relationship with liquid in the lower pressure rectification column is employed to meet the requirements for liquid nitrogen reflux in that column. There is, however, usually an excess of liquid nitrogen produced by this condensation. Accordingly, some of the condensate is preferably pumped to the higher pressure rectification column and may be used either to supplement the reflux in that column or to supplement the liquid nitrogen which is taken for indirect heat exchange with the second stream of compressed air. The rate at which liquid nitrogen is pumped from the second further condenser to the higher pressure rectification column is, however, less than the rate at which liquid nitrogen is passed into heat exchange relationship with the second stream of compressed air.

The method and apparatus according to the invention is typically employed for the generation of nitrogen without any production of a pure oxygen or an argon product. Accordingly, therefore, the mole fraction of oxygen in the bottom of the lower pressure rectification column can be limited to a value in the range of about 0.55 to about 0.75.

Preferably, a third air stream to be separated is compressed to a higher pressure than the first and second air streams, is expanded with the performance of external work, and is introduced into the lower pressure rectification column. Accordingly, the apparatus according to the invention preferably additionally includes a booster-compressor for raising the pressure of the third air stream to above that of the first air stream, and an expansion turbine for expanding the third air stream with the performance of external work having an inlet communicating with the outlet of the said booster-compressor and an outlet communicating with an intermediate mass exchange region of the lower pressure rectification column. The external work that is performed is preferably the compression of the third air stream, and for this purpose the booster-compressor is preferably adapted to be driven by the expansion turbine.

Particularly in examples of the method and apparatus according to the invention in which the first compressed air stream to be separated is partially or totally condensed by indirect heat exchange with liquid obtained in a lower region of the higher pressure rectification column, a stream of compressed air and/or a stream of liquid withdrawn from an intermediate mass exchange region of the higher pressure rectification column preferably has nitrogen separated from it in an intermediate pressure rectification column which operates at its top at a pressure greater than that at the bottom of the lower pressure rectification column and at its bottom at a pressure less than that at the top of the higher pressure rectification column. Nitrogen so separated is condensed and an oxygen-containing liquid fraction obtained in a lower region of the intermediate pressure rectification column is reboiled. Thus, the apparatus according to the invention preferably additionally includes an intermediate pressure rectification column having an inlet for a stream of condensed air and/or liquid withdrawn from an intermediate mass exchange region of the higher pressure rectification column, the intermediate pressure rectification column having a condenser for condensing nitrogen associated with an upper region thereof and a reboiler associated with a lower region thereof. Operation of the intermediate pressure rectification column makes possible a further enhancement of the reflux available to the arrangement of rectification columns and thereby enables the rate at which nitrogen condensed in the first condenser-reboiler can be taken as product.

The oxygen-containing liquid fraction obtained in the lower region of the intermediate pressure rectification column is preferably reboiled by a stream of nitrogen vapour taken from the higher pressure rectification column. Thus, the reboiler associated with the lower region of the intermediate pressure rectification column has condensing passages associated with an outlet of nitrogen vapour from the higher pressure rectification column.

The nitrogen separated in the intermediate pressure rectification column is preferably condensed by indirect heat exchange with a stream of the oxygen-containing liquid fraction obtained in the lower region of the intermediate pressure rectification column, said stream of the oxygen-containing liquid fraction being reduced in pressure upstream of its heat exchange with the nitrogen separated in the further rectification column. Thus, in the apparatus according to the invention the condenser associated with the upper region of the intermediate pressure rectification column preferably has cooling passages which communicate at their upstream end through a pressure reducing valve with an outlet for oxygen-enriched liquid from the lower region of the intermediate pressure rectification column.

The method according to the invention is particularly suited for operation at relatively elevated pressure. Thus, for example, the lower pressure rectification column may operate at a pressure in the range of about 2.5 to about 5 bar at its top.

The air streams may be taken from a source of compressed air which has been purified by extraction therefrom of water vapour, carbon dioxide, and, if desired, hydrocarbons and which has been cooled in indirect heat exchange with products of the air separation.

The term "rectification column" as used herein, encompasses any distillation or fractionation column, zone or zones, where liquid and vapour phases are countercurrently contacted to effect separation of the fluid mixture, as, for example, by contacting the vapour and liquid phases on packing elements or a series of vertically spaced trays or plates mounted within the column, zone or zones. A rectification column may comprise a plurality of zones in separate vessels so as to avoid having a single vessel of undue height.

BRIEF DESCRIPTION OF THE DRAWINGS

The method and apparatus according to the present invention will now be described by way of example with reference to the accompanying drawings, in which.

The drawings are not to scale. Like parts of different Figures are identified by the same reference numerals.

DETAILED DESCRIPTION OF THE INVENTION

Figure 1:
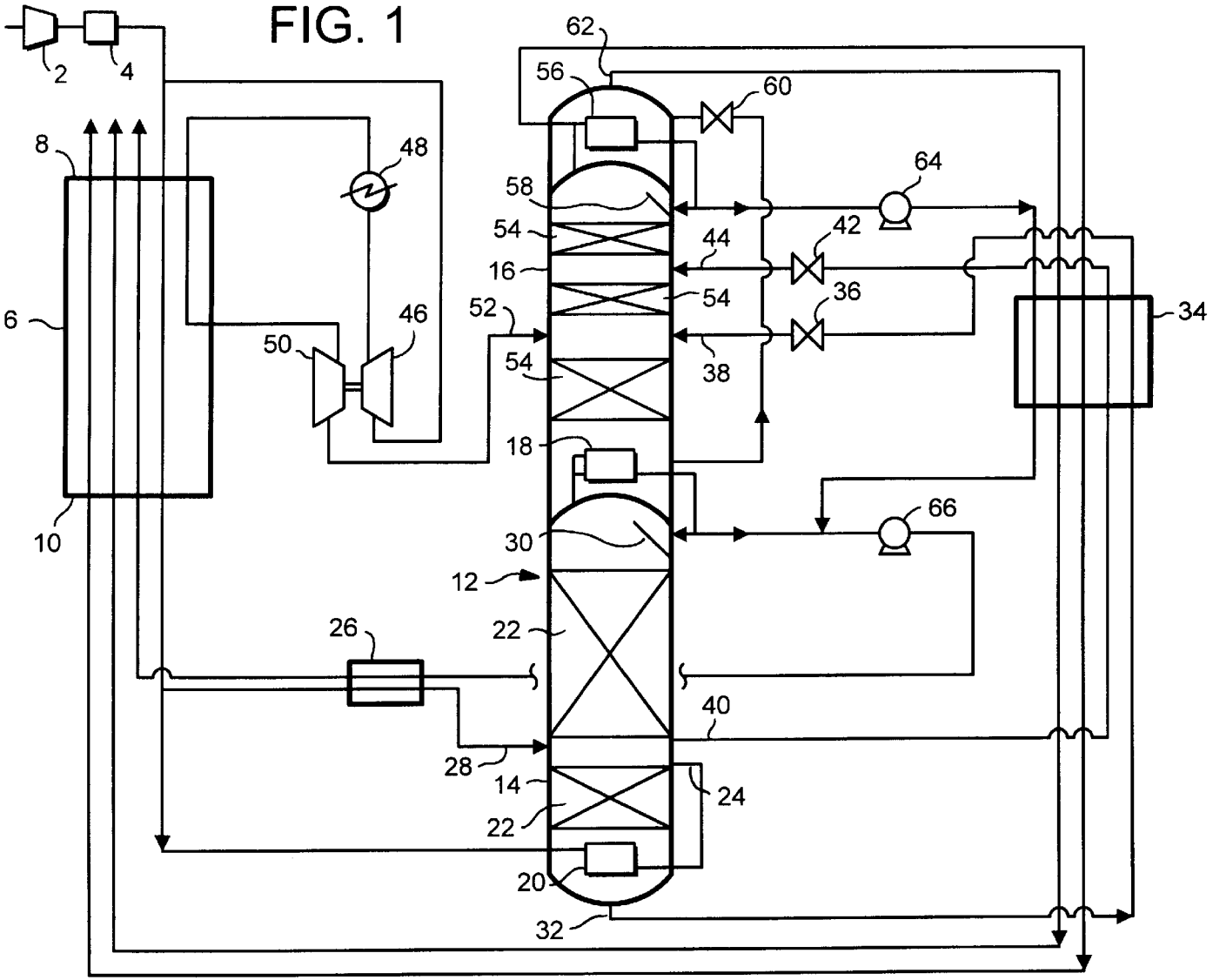
FIGS. 1, 2 and 3 are all schematic flow diagrams of respective air separation plants.

Referring to FIG. 1 of the drawings, a flow of air is compressed in a main air compressor 2 which has an aftercooler (not shown) associated therewith and is purified in an adsorption unit 4. The purification comprises the removal from the air flow of impurities of relatively high boiling point, particularly water vapour and carbon dioxide, which would otherwise freeze in low temperature parts of the plant. The unit 4 may effect the purification by pressure swing adsorption or temperature swing adsorption. The unit 4 may additionally include one or more layers of catalyst for the removal of carbon monoxide and hydrogen impurities. Such removal of carbon monoxide and hydrogen impurities is described in EP-A-438 282. The configuration and operation of such adsorptive purification units are well known and need not be described further herein.

Downstream of the purification unit 4 the air flows through a main heat exchanger 6 from its warm end 8 to its cold end 10. The air is thus cooled to a temperature suitable for its separation by rectification or a temperature only a little thereabove. Downstream of the cold end 10 of the main heat exchanger 6 the flow of cooled air is divided into first and second compressed air streams. The first and second air streams are separated in a double rectification column 12 comprising a higher pressure rectification column 14, a lower pressure rectification column 16, and a first condenser-reboiler 18, of which the condensing passages (not shown) communicate with an upper region of the higher pressure rectification column so as to condense nitrogen, and the reboiling passages (not shown) communicate with a lower region of the lower pressure rectification column.

The first flow of air is passed through the condensing passages (not shown) of a second condenser-reboiler 20 which (as shown) is located in the bottom of the higher pressure rectification column 14, but which could be located externally of the column 14. A bottom liquid fraction in the lower region of the higher pressure rectification column 12 is reboiled in the boiling passages (not shown) of the second condenser-reboiler 20. The higher pressure rectification column 14 contains members 22 defining liquid-vapour contact surfaces so as to bring into intimate mass transfer relationship vapour ascending from the second condenser-reboiler 20 with liquid nitrogen condensed in the first condenser-reboiler 18. As a result, nitrogen is separated from the ascending vapour. The partially or totally condensed first stream of air flows from the second condenser-reboiler 20 into an intermediate mass exchange region of the higher pressure rectification column 14 through an inlet 24.

The second stream of compressed air flows through the condensing passages of a further condenser 26 in which it is partially or totally condensed. The resulting partially or totally condensed second air stream is introduced into the higher pressure rectification column 14 through an inlet 28 of generally the same level as the inlet 24.

Nitrogen separated from the air in the higher pressure rectification column 14 is condensed in the condensing passages (not shown) of the first condenser-reboiler 18, and the resulting condensed nitrogen is returned to a collector 30 in the higher pressure rectification column 14. Liquid nitrogen reflux is distributed to the column 14 from the collector 30. A stream of oxygen-enriched liquid is withdrawn from the bottom of the higher pressure rectification column 14 through an outlet 32, is sub-cooled by passage through a heat exchanger 34, and is introduced into the lower pressure rectification column 16 via a throttling valve 36 and an inlet 38. Two other streams of oxygen-nitrogen mixture are introduced into the lower pressure rectification column 16 for separation. One of these streams is composed of a liquid mixture of oxygen and nitrogen withdrawn from the higher pressure rectification column 14 through an outlet 40 at generally the same level as the inlet 24 and 28. The stream of liquid withdrawn through the outlet 40 has a composition approximating to that of the air leaving the purification unit 4. The stream of liquid mixture withdrawn through the outlet 40 is sub-cooled by passage through the heat exchanger 34, is reduced in pressure by passage through a throttling valve 42, and is introduced into the lower pressure rectification column 16 through an inlet 44 typically at a higher level than the inlet 38. A third stream of compressed air is also introduced into the lower pressure rectification column 16. The third stream of compressed air is taken from the purified air upstream of the warm end 8 of the main heat exchanger 6, is further compressed in a compressor 46, has the heat of compression removed therefrom by passage through an aftercooler 48, and is passed through the main heat exchanger 6 from its warm end 8. The third compressed air stream is withdrawn from an intermediate region of the main heat exchanger 6 and is expanded in an expansion turbine 50 and introduced into the lower pressure column 16 through an inlet 52. As shown in FIG. 1, the expansion turbine 50 is so coupled to the booster-compressor 46 that the expanding air is able to do work by driving the compressor 46. The resulting further compressed air stream passes from the booster-compressor 50 through an inlet 52 into the lower pressure rectification column 16 at the same level as a inlet 38.

The above-mentioned streams are separated in the lower pressure rectification column 16 into a top nitrogen vapour fraction, which is essentially pure, typically containing more than 99.9% by volume of nitrogen, and an impure bottom oxygen-enriched liquid air fraction, which is impure, typically containing from 55 to 75% by volume of oxygen. The first condenser-reboiler 18 reboils part of the bottom oxygen-enriched liquid fraction, thereby providing a flow of vapour that ascends the column 16, and the ascending vapour is brought into intimate mass-exchange contact with descending liquid by liquid-vapour contact members 54 which may take the form of distillation trays or packing, for example, structured packing. A stream of the nitrogen vapour fraction obtained at the top of the lower pressure rectification column 16 is condensed in a second further condenser 56. The resulting condensate is returned to a collector 58 in the lower pressure rectification column 16 from which it is distributed to the liquid-vapour contact members 54. Cooling for the second further condenser is provided by taking a part of the bottom oxygen-enriched liquid fraction obtained in the lower pressure rectification column 16, passing it through a throttling valve 60, and introducing it into vaporising passages (not shown) of condenser 56. The oxygen-enriched liquid thus condenses the nitrogen in the condenser 56 and is itself vaporised. The resulting vapour leaves the condenser 56 via an outlet 62, passes through the heat exchanger 34 countercurrently to the liquid streams being sub-cooled therein, thereby providing the necessary cooling for the heat exchanger 34. The oxygen-enriched vapour stream flows from the heat exchanger 34 through the main heat exchanger 6 from its cold end 10 to its warm end 8 and is discharged from the plant as a waste product. A lower pressure gaseous nitrogen product is taken from the top of the lower pressure rectification column 14 and passes through the heat exchangers 34 and 6 cocurrently with the oxygen enriched waste.

The nitrogen condensed in the second further condenser 56 is typically in excess of the requirements for reflux of the lower pressure rectification column 16. A stream of liquid nitrogen is withdrawn from the collector 58 by a pump 64 which passes the stream through the heat exchanger 34, cocurrently with the nitrogen product stream, to the collector 30 located inside the higher pressure rectification column 14. A stream of liquid nitrogen is withdrawn from the collector 30 by a pump 66 which raises the pressure of the liquid to a pressure in excess of any pressure that obtains in the higher pressure rectification column. This pressurised flow of liquid nitrogen is vaporised by passage through the first further condenser 26 as a result of indirect heat exchange between it and the second stream of compressed air which is partially or totally condensed within the condenser 26. The resulting vaporised, pressurised nitrogen stream flows through the main heat exchanger 6 from its cold end 10 to its warm end 8 and is taken as nitrogen product. The two nitrogen products may be further compressed in one or more further compressors (not shown). A feature of the air separation method and apparatus illustrated in FIG. 1 is that in comparison with conventional nitrogen generators employing a double rectification column, load is shifted from the nitrogen product compressor to the main air compressor 2. Withdrawing liquid nitrogen product from the first condenser-reboiler 18 via the collector 30 enables the higher pressure rectification column to be operated relatively efficiently since in the absence of such withdrawal of the liquid nitrogen product, the upper section, in particular, of the column 14 would tend to be over-refluxed.

Various modifications and improvements may be made to the air separation plant shown in FIG. 1. If the second stream of compressed air is only partially condensed in the condenser 26, which practice is generally preferred to total condensation because it reduces the temperature differences in the condenser, the resulting partially condensed second air stream is preferably passed to a phase separator (not shown) provided with an overhead condenser (not shown) the condensation duty of which is provided by expanding through a valve (not shown) a part of the liquid phase collected in the separator. Liquid is withdrawn from the phase separator and introduced into the higher pressure rectification column 14. Such an arrangement enables the pressure of the nitrogen flowing through the condenser 26 to be increased slightly, thereby making a corresponding reduction in the nitrogen product compression duty.

It is also advantageous to pass the nitrogen stream taken from the collector 30 through the heat exchanger 34. Similarly, the oxygen-enriched liquid stream may be sub-cooled by passage through the heat exchanger 34. It is also possible to withdraw a nitrogen vapour stream from the top of the higher pressure rectification column 14 and pass this stream firstly through the heat exchanger 34 and secondly through the main heat exchanger 6 from its cold end 10 to its warm end 8 so as to provide a further stream of nitrogen product at elevated pressure.

In a typical example of the operation of the plant shown in FIG. 1 of the drawings, the pressure at the top of the higher pressure rectification column is in the order of 7.8 bar, the pressure at the top of the lower pressure rectification column 16 is the order of 4 bar, the higher pressure nitrogen product was produced at a pressure of 12 bar, and the waste oxygen purity was about 62%. About 48.5% of the total nitrogen product was produced at the higher pressure.

In general, improved performance can be achieved by increasing the waste oxygen purity to about 70% so as to increase nitrogen recovery. Such a practice typically entails increases the operating pressures of the columns 14 and 16. As a result, the pressure of the nitrogen products is increased and therefore less power needs to be expended in compressing the nitrogen. Such extra power usually more than compensates any increases in the power consumed by the main air compressor 2.

Figure 2:
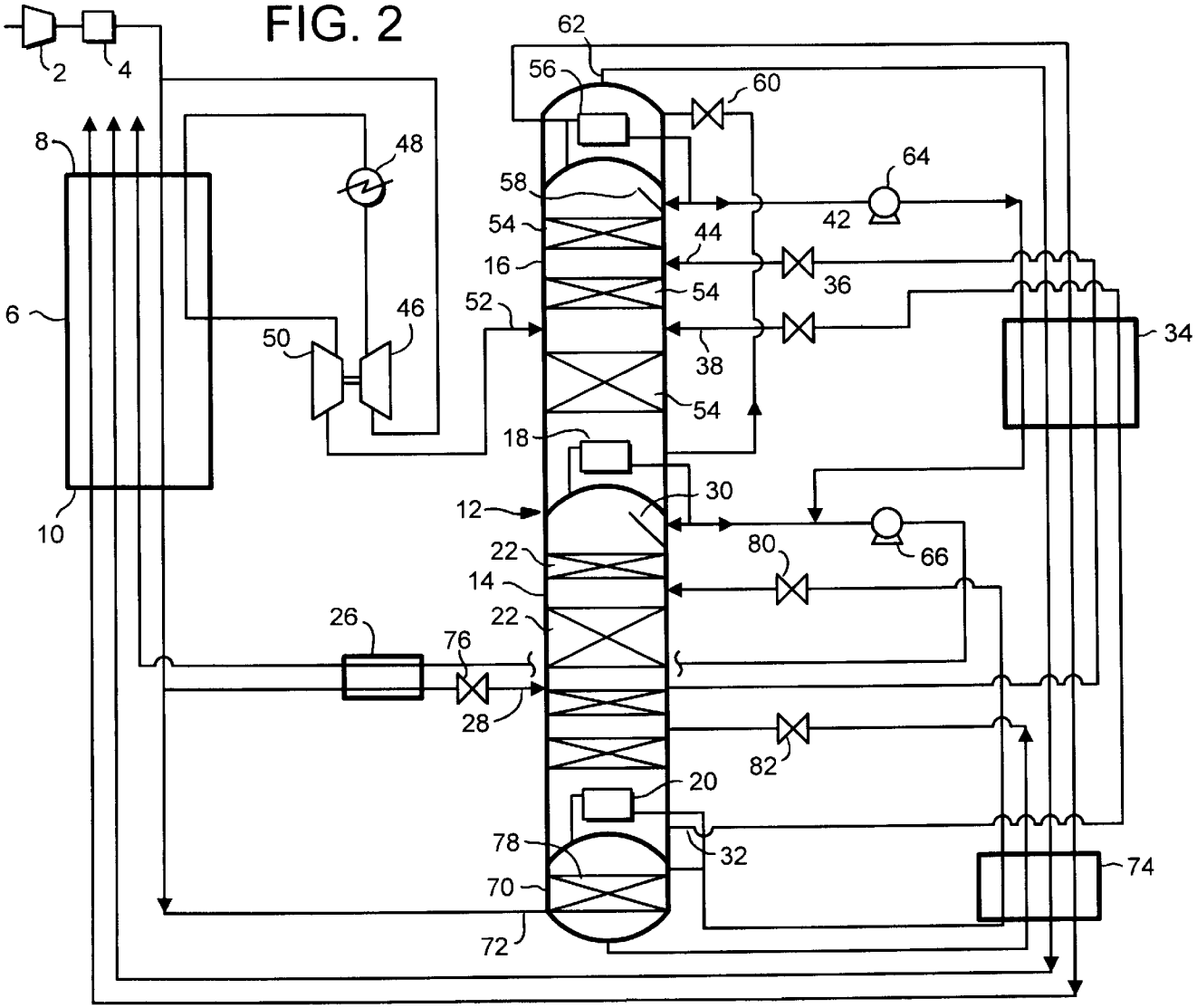

Referring now to FIG. 2 of the accompanying drawings, the air separation plant shown therein is generally similar in configuration and operation to that shown in FIG. 1 except that the second condenser-reboiler 20 is heated by a stream of nitrogen-rich vapour separated in a further rectification column 70 into which the first air stream is introduced through an inlet 72, and that a further heat exchanger 74 is interposed between the main heat exchanger 6 and the heat exchanger 34 to enable the nitrogen product stream taken from the lower pressure rectification column 16 to sub-cool the products of the further rectification column 70. Because the first stream of compressed air is introduced into the further rectification column 70, the higher pressure rectification column 14 is operated at a lower pressure for a given outlet pressure of the main air compressor 2 than in the plant shown in FIG. 1. Accordingly, a throttling valve 76 is interposed between inlet 28 to the higher pressure rectification column 14 and the condenser 26.

The further rectification column 70 is typically relatively small and contains only a few, say five, theoretical trays, that is to say it contains sufficient liquid vapour-contact members 78 therein to provide five theoretical stages of separation. In general, a pure nitrogen vapour fraction is not obtained at the top of the further rectification column 70, this fraction typically containing at least about 10% by volume of oxygen. The nitrogen-rich vapour is condensed in the second condenser-reboiler 20. A part of the resulting condensate is used as reflux in the further rectification column 70. Another part is sub-cooled by passage through the heat exchanger 74, is passed through a throttling valve 80 and is introduced into the higher pressure rectification column 14 at a level near the top of the liquid vapour contact devices 22 provided therein. A stream of oxygen-enriched liquid is withdrawn from the bottom of the further rectification column 70, is sub-cooled by passage through the heat exchanger 74, is passed through a throttling valve 82, and is introduced into the higher pressure rectification column 14 at a level below that of the inlet 28.

Although in general the condenser-reboiler 20 can be operated with lower temperature differences in the plant shown in FIG. 2 than in that shown in FIG. 1, these temperature differences could be further reduced by increasing the purity of nitrogen-rich vapour at the top of the further rectification column 70. In order to achieve this, either the inlet pressure to the column 70 may be increased, thereby requiring more power to be consumed by compressing the air, and/or the nitrogen recovery may be reduced.

A feature of the air separation plant shown in FIG. 1 and 2 is that the section of the lower pressure rectification column 16 from the reboiler 18 to the inlet 38 tends to operate relatively inefficiently as can be demonstrated by plotting a McCabe-Thiele diagram. Such a diagram would show a marked divergence between the operating and equilibrium lines. Improved efficiency can be given by separating a stream of liquid withdrawn from a lower region of the higher pressure rectification column in an intermediate pressure rectification column. Such an arrangement is shown in FIG. 3.

Figure 3:
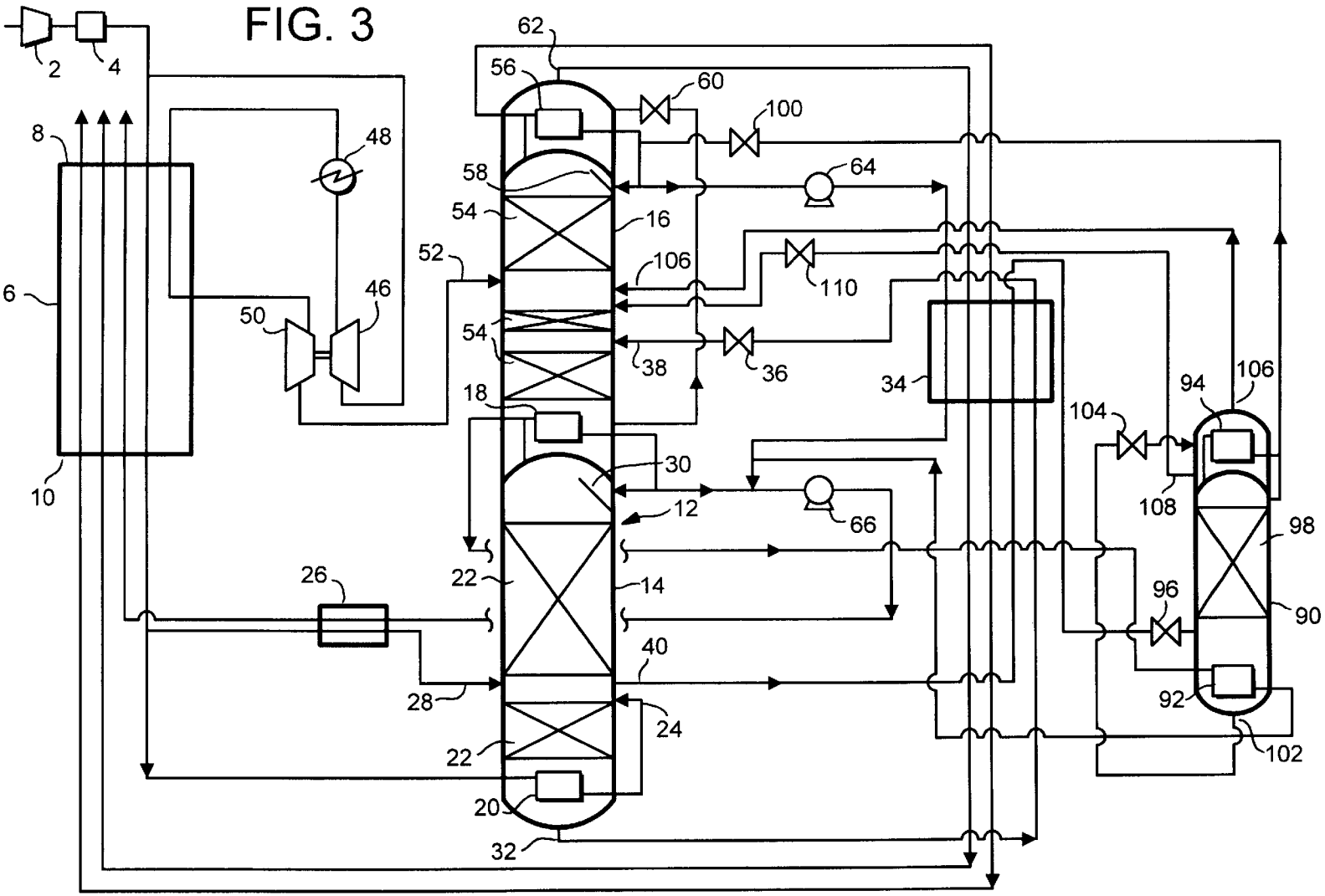

Referring to FIG. 3, there is shown therein an air separation plant generally similar to that shown in FIG. 1 save that it includes an intermediate pressure rectification column 90 having a reboiler 92 associated with a lower region thereof and a condenser 94 associated with an upper region thereof. Various additional conduits and valves provided in order to integrate the intermediate pressure rectification column 90 into the arrangement column as shown in FIG. 3. Whereas in the plant shown in FIG. 1 the stream of oxygen-liquid mixture withdrawn from the higher pressure rectification column 14 through the outlet 40 flows via the heat exchanger 34 to the lower pressure rectification column 16, this stream is employed as the feed to the intermediate pressure rectification column 90 in the plant shown in FIG. 3. Thus, the stream flows from the heat exchanger 34 through a throttling valve 96 into the intermediate pressure rectification column 90. The reboiler 92 vaporises liquid collecting in the bottom of the column 90. The resulting vapour ascends the column 90 and comes into intimate mass exchange relationship with descending liquid on liquid-vapour contact members 98 which may be provided by distillation trays or by packing, for example, structured packing. As a result nitrogen is separated from the incoming liquid. Nitrogen vapour collects at the top of the column and is condensed in the condenser 94 which is in an overhead position in relation to the column 90. A part of the resulting condensed nitrogen is reintroduced into the top of the intermediate pressure rectification column 90 and provides reflux for the column 90. The remaining condensed nitrogen flows through a throttling valve 100 to the collector 58 in the lower pressure rectification column 16.

The nitrogen is condensed in the condenser 94 by indirect heat exchange with a stream of oxygen-enriched liquid withdrawn from the bottom of the intermediate pressure rectification column 90 through an outlet 102. This stream of oxygen enriched liquid is passed through a throttling valve 104 to reduce its temperature intermediate the outlet 102 and the condenser 94. The oxygen-enriched liquid is partially vaporised in the condenser 94. The resulting vapour flows through an outlet 106 and is introduced into the lower pressure rectification column 16 through an inlet 106 typically but not necessarily located at the same level as inlet 52. The residual liquid is withdrawn from the condenser 94 through an outlet 108 and flows into the lower pressure rectification column 16 at generally the same level as the inlet 106, passing through a throttling valve 110 en route.

The liquid at the bottom of the intermediate pressure rectification column 90 is reboiled in the reboiler 92 by indirect heat exchange with a stream of nitrogen vapour withdrawn from the top of the higher pressure rectification column 14. As a result of the heat exchange in the reboiler 92 the nitrogen is condensed. The resulting condensate is returned to the collector 30 in the higher pressure rectification column 14.

By integrating the intermediate pressure rectification column 90 into the air separation plant there is made possible an increase in the proportion of the total nitrogen product which may be produced at higher pressure.

In a modification to the plant shown in FIG. 3, the feed to the intermediate pressure rectification column 90 may be taken in part or entirely from the bottom of the higher pressure rectification column 14. In such an example, the purity of the nitrogen separated in the intermediate pressure rectification column 90 is typically reduced and the condensed impure nitrogen not required as reflux in the column 90 is provided to an intermediate mass exchange region of the lower pressure rectification column 16.

Typically, in operation of the plant shown in FIG. 3 the pressure at the top of the intermediate pressure rectification column 90 is in order of about 6 bars.

I claim:

1. A method of separating air comprising:

introducing the air into a double rectification column comprising a higher pressure rectification column, a lower pressure rectification column, and a first condenser-reboiler, of which the condensing passages communicate with an upper region of the higher pressure rectification column so as to condense nitrogen, and the reboiling passages communicate with a lower region of the lower pressure rectification column;

operating a second condenser-reboiler so as to reboil a liquid fraction obtained in the higher pressure rectification column, the second condenser-reboiler being heated either by means of a first stream of compressed air to be separated, the first stream of air thereby being partially or totally condensed, or by a flow of nitrogen-rich vapour formed by pre-separating the first stream of air in a further rectification column operating at a higher pressure than any obtaining in the higher pressure rectification column, the nitrogen-rich vapour thereby being partially or totally condensed;

partially or totally condensing a second stream of compressed air to be separated by indirect heat exchange with a stream of the condensed nitrogen; and taking at least part of the stream of condensed nitrogen as product downstream of its heat exchange with the second stream of compressed air.

2. The method according to claim 1, in which the first and second streams of compressed air are condensed at the same pressure.

3. The method according to claim 1, in which the said part of the stream of condensed nitrogen is taken from the higher pressure rectification column and is pumped to a pressure higher than that at the top of the higher pressure column upstream of its heat exchange with the second stream of compressed air.

4. The method according to claim 1, in which a product nitrogen stream is withdrawn in vapour state from the lower pressure rectification column.

5. The method according to claim 1, in which a stream of nitrogen vapour is taken out of mass exchange relationship with liquid in the lower pressure rectification column and is condensed.

6. The method according to claim 5, in which a stream of oxygen-enriched liquid is withdrawn from the lower pressure rectification column, is reduced in pressure and is employed to condense the stream of nitrogen vapour taken out of mass exchange relationship with liquid in the lower pressure rectification column.

7. The method according to claim 5, in which some of the nitrogen vapour withdrawn from the lower pressure rectification is downstream of its condensation pumped to the higher pressure rectification column.

8. The method according to claim 1, in which a third air stream to be separated is compressed to a higher pressure than the first air stream, is expanded with the performance of external work, and is introduced into the lower pressure rectification column.

9. The method according to claim 1, in which a stream of condensed air and/or a stream of liquid withdrawn from an intermediate mass exchange region of the higher pressure rectification column have nitrogen separated from it in an intermediate pressure rectification column which operates at its top at a pressure greater than that at the bottom of the lower pressure rectification column and at its bottom at a pressure less than that at the top of the higher pressure rectification column, the nitrogen so separated is condensed, and an oxygen-containing liquid fraction obtained in a lower region of the intermediate pressure rectification column is reboiled.

10. The method according to claim 9, in which the nitrogen separated in the intermediate pressure rectification column is condensed by indirect heat exchange with the stream of the oxygen-containing liquid fraction contained in the said lower region of the intermediate pressure rectification column, said stream of the oxygen-containing liquid fraction being reduced in pressure upstream of its heat exchange with the nitrogen separated in the intermediate pressure rectification column, and in which the oxygen-containing liquid fraction obtained in the lower region of the intermediate pressure rectification column is reboiled by a stream of nitrogen vapour taken from the higher pressure rectification column.

11. An apparatus for separating air, comprising:

a double rectification column comprising a higher pressure rectification column, a lower pressure rectification column, and a first condenser-reboiler, of which the condensing passages communicate with an upper region of the higher pressure rectification column so as to condense nitrogen, and the reboiling passages communicate with a lower region of the lower pressure rectification column;

a second condenser-reboiler, of which the reboiling passages communicate with a lower region of the higher pressure rectification column and the condensing passages communicate either directly with the source of the first stream of compressed air to be separated or with a nitrogen-rich vapour region of a further rectification column which in turn communicates with the said source;

a first further condenser for partially or totally condensing, by indirect heat exchange with a stream of the condensed nitrogen, a second stream of compressed air to be separated; and means for taking as product at least part of the stream of condensed nitrogen downstream of its heat exchange with its second stream of compressed air.

12. The apparatus according to claim 11, additionally including a pump for pressurising a stream of condensed nitrogen to a higher pressure than the operating pressure at the top of the higher pressure rectification column upstream of its heat exchange of the second stream of compressed air.

13. The apparatus according to claim 11, additionally including a second further condenser which is associated with the lower pressure rectification column and which is arranged to condense nitrogen.

14. The apparatus according to claim 13, in which the second further condenser has cooling passages which at their upstream end communicate through a pressure reducing valve with an outlet from the lower region of the lower pressure rectification column for a stream of oxygen-enriched liquid.

15. The apparatus according to claim 13, additionally including a pump for pumping to the higher pressure rectification column liquid nitrogen condensed in the second further condenser.

16. The apparatus according to claim 11, additionally including a booster-compressor for raising the pressure of a third air stream to be separated to above that of the first compressed air stream, and an expansion turbine for expanding the third air stream with the performance of external work having an inlet communicating with the outlet of the said booster-compressor and an outlet communicating with an intermediate mass exchange region of the lower pressure rectification column.

17. The apparatus according to claim 11, additionally including an intermediate pressure rectification column having an inlet for a stream of condensed air and/or liquid withdrawn from an intermediate mass exchange region of the higher pressure rectification column, the intermediate pressure rectification column having a condenser for condensing nitrogen associated with an upper region thereof and a reboiler associated with a lower region thereof.

18. The apparatus according to claim 17, in which the condenser associated with the upper region of the intermediate pressure rectification column has cooling passages which communicate at their upstream end through a pressure reducing valve with an outlet for oxygen-enriched liquid from the lower region of the intermediate pressure rectification column.

19. The apparatus according to claim 17, in which the reboiler associated with the lower region of the intermediate pressure rectification column has condensing passages communicating with an outlet for nitrogen vapour from the higher pressure rectification column.

* * * * *